US009486992B2

(12) United States Patent
St. Ours et al.

(10) Patent No.: US 9,486,992 B2
(45) Date of Patent: Nov. 8, 2016

(54) CONVEYOR AND METHOD FOR CHANGING THE PITCH OF PRINTED PRODUCTS

(71) Applicant: Goss International Americas, Inc., Durham, NH (US)

(72) Inventors: Joseph Adrian St. Ours, Lee, NH (US); Lothar John Schroeder, West Chester, PA (US); Barry Mark Jackson, York, ME (US); Dieter T. Ebert, North Hampton, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 14/721,845

(22) Filed: May 26, 2015

(65) Prior Publication Data

US 2015/0251406 A1 Sep. 10, 2015

Related U.S. Application Data

(63) Continuation of application No. 12/072,947, filed on Feb. 29, 2008, now abandoned.

(51) Int. Cl.
*B65H 29/12* (2006.01)
*B41F 3/58* (2006.01)
(Continued)

(52) U.S. Cl.
CPC ..... *B41F 3/58* (2013.01); *B65H 5/062* (2013.01); *B65H 7/02* (2013.01); *B65H 29/12* (2013.01); *B65H 29/6618* (2013.01); *B65H 29/68* (2013.01); *B65H 5/34* (2013.01); *B65H 29/6609* (2013.01); *B65H 2301/44522* (2013.01); *B65H 2404/1112* (2013.01); *B65H 2511/22* (2013.01); *B65H 2513/108* (2013.01); *B65H 2513/20* (2013.01); *B65H 2555/24* (2013.01); *B65H 2557/242* (2013.01); *B65H 2701/1932* (2013.01); *B65H 2801/21* (2013.01)

(58) Field of Classification Search
USPC ..... 400/636
See application file for complete search history.

(56) References Cited

U.S. PATENT DOCUMENTS 2,152,288 A 3/1939 Seybold
2,580,469 A * 1/1952 Schwartz ..... 198/457.07
(Continued)

FOREIGN PATENT DOCUMENTS

JP H0597307 4/1993
JP 2005059969 3/2005
(Continued)

*Primary Examiner* — Jill Culler
(74) *Attorney, Agent, or Firm* — Davidson, Davidson & Kappel, LLC

(57) ABSTRACT

A printing press is provided. The printing press includes a print unit printing a stream of printed products having a first pitch, a pitch changing device and a controller. The pitch changing device includes an upper roller mounted on an upper axle, a lower roller mounted on a lower axle, the upper and lower rollers forming a roller nip and at least one motor driving the upper and lower rollers in opposite directions. The roller nip receives the stream of printed products. The controller is connected to the at least one motor and is configured to decrease an initial velocity of the roller nip to a final velocity using an electronic cam velocity profile and to increase the final velocity of the nip to the initial velocity after releasing the printed products over a longer period of a cycle of the electronic cam velocity profile than decreasing the initial velocity to the final velocity. A method is also provided.

14 Claims, 8 Drawing Sheets

(51) Int. Cl.

| | |
|---|---|
| ***B65H 5/06*** | (2006.01) |
| ***B65H 7/02*** | (2006.01) |
| ***B65H 29/68*** | (2006.01) |
| *B65H 29/66* | (2006.01) |
| *B65H 5/34* | (2006.01) |

(56) References Cited

U.S. PATENT DOCUMENTS

| | | | | |
|---|---|---|---|---|
| 3,685,823 | A * | 8/1972 | Chambon | 271/182 |
| 3,827,545 | A * | 8/1974 | Buhayar | 198/461.2 |
| 3,913,478 | A | 10/1975 | Terzuolo et al. | |
| 3,913,479 | A | 10/1975 | Cappel | |
| 4,451,027 | A * | 5/1984 | Alper | 271/10.02 |
| 4,987,991 | A * | 1/1991 | Marschke | 198/461.1 |
| 5,265,861 | A * | 11/1993 | Schaffner et al. | 271/182 |
| 5,423,527 | A * | 6/1995 | Tranquilla | 271/10.02 |
| 5,560,599 | A | 10/1996 | Curley et al. | |
| 5,711,518 | A * | 1/1998 | Portaro et al. | 271/10.03 |
| 5,794,929 | A * | 8/1998 | Curley et al. | 271/270 |
| 5,813,327 | A * | 9/1998 | Freeman et al. | 101/93 |
| 6,176,485 | B1 * | 1/2001 | Wingate | 271/303 |
| 6,302,391 | B1 | 10/2001 | Robert | |
| 6,405,850 | B1 * | 6/2002 | Jackson et al. | 198/462.3 |
| 6,450,321 | B1 | 9/2002 | Blumenthal et al. | |
| 6,520,497 | B2 * | 2/2003 | Tamura | 271/122 |
| 6,543,767 | B1 | 4/2003 | Krouse | |
| 6,561,507 | B1 * | 5/2003 | Pollock | 271/182 |
| 6,585,263 | B1 | 7/2003 | Bredenberg | |
| 6,644,660 | B2 * | 11/2003 | Sussmeier et al. | 271/270 |
| 6,685,184 | B2 * | 2/2004 | Tufekci et al. | 271/270 |
| 6,719,123 | B2 | 4/2004 | Jackson et al. | |
| 6,761,676 | B2 | 7/2004 | Wingate et al. | |
| 7,527,262 | B2 | 5/2009 | Beckstrom | |
| 2005/0156373 | A1 | 7/2005 | Konagaya | |
| 2007/0052159 | A1 | 3/2007 | Wingate | |
| 2007/0158903 | A1 * | 7/2007 | Cote et al. | 271/270 |

FOREIGN PATENT DOCUMENTS

| | | |
|---|---|---|
| WO | WO2006111322 | 10/2006 |
| WO | WO2007/081701 | 7/2007 |

* cited by examiner

CONVEYOR AND METHOD FOR CHANGING THE PITCH OF PRINTED PRODUCTS

CROSS REFERENCE TO RELATED APPLICATIONS

This is a continuation of U.S. application Ser. No. 12/072,947 filed on Feb. 29, 2008, the entire disclosure of which is hereby incorporated by reference herein.

BACKGROUND

The present invention relates generally to printing presses and more particularly to printing presses with conveyors altering the pitch of printed products printed in the printing press.

U.S. Pat. No. 6,176,485, hereby incorporated by reference herein, discloses a diverting device for a continuous sequence of flat products traveling in a product travel plane. A first product exit path and a second product exit path emerge both from said product travel plane.

U.S. Pat. No. 6,405,850 discloses an apparatus for advancing and/or slowing signatures in a printing press. The apparatus and method includes a series of two or more belt drives, where each belt drive includes at least a pair of opposed belts. The belts are preferably timing or toothed belts driven by sprockets.

U.S. Pat. No. 6,561,507 discloses a folder apparatus that includes a conveyor and knock-down wheel assembly to receive signatures from, for example, a tape system output. The conveyor and knock-down wheel assembly slow down the signatures from the tape system and create a shingled output stream of signatures.

BRIEF SUMMARY OF THE INVENTION

The present invention provides a printing press including:

a print unit printing a stream of printed products, the printed products having a first pitch; and a pitch changing device including;

an upper roller mounted on an upper axle;

a lower roller mounted on a lower axle, the upper and lower rollers forming a roller nip; and a motor driving the upper and lower rollers in opposite directions;

the nip receiving the stream of printed products;

the motor varying the velocity of the nip and the printed products using an electronic cam velocity profile so as to alter the first pitch.

The present invention also provides a method for changing the velocity of printed products in a product stream including the steps of:

moving printed products at a first velocity and a first pitch;

rotating a nip of two rollers at the first velocity;

receiving the printed products at the nip; and changing the first velocity of the nip and printed products to a second velocity that is different from the first velocity using an electronic cam velocity profile so as to alter the first pitch.

BRIEF DESCRIPTION OF THE DRAWINGS

A preferred embodiment of the present invention will be elucidated with reference to the drawings, in which.

DETAILED DESCRIPTION OF PREFERRED EMBODIMENTS

Figure 1:
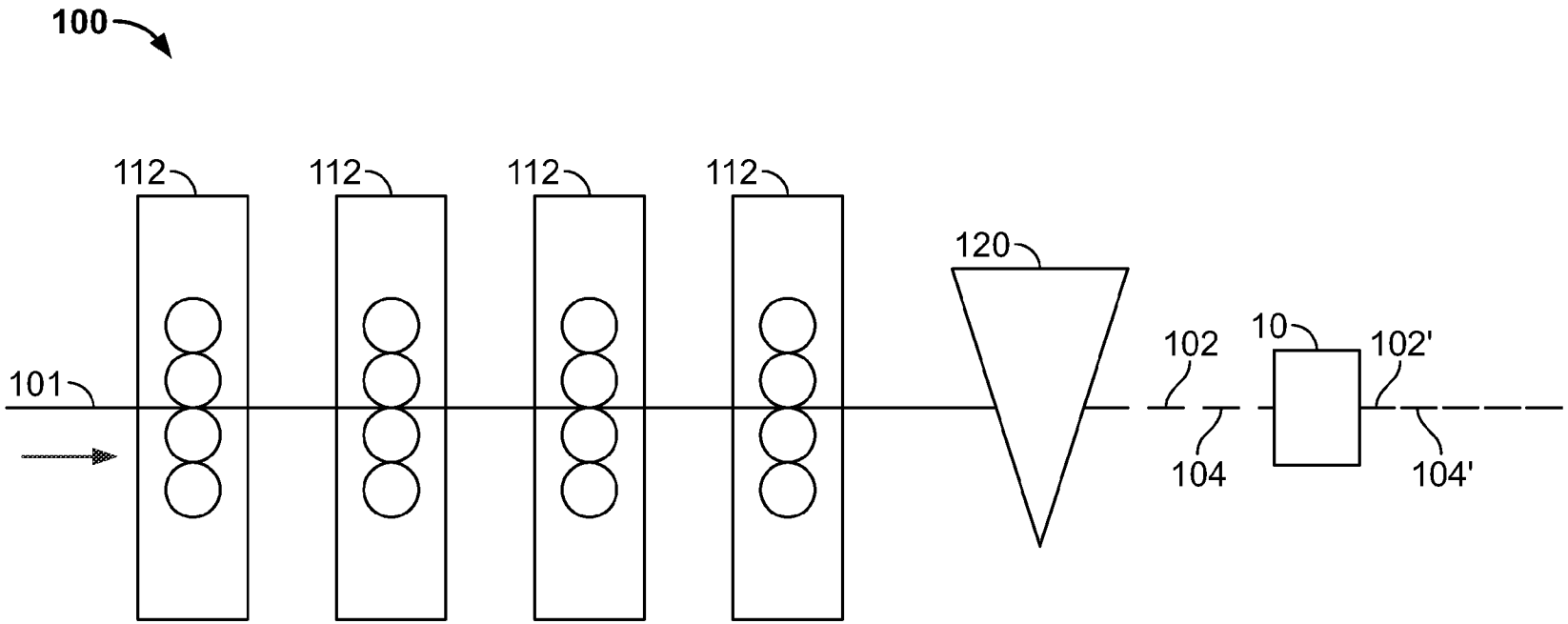
FIG. 1 shows a printing press according to the present invention.

FIG. 1 shows a preferred embodiment of a web printing press 100 in accordance with the present invention including a web 101 traveling through a plurality of printing units 112 and a folder 120 providing a plurality of signatures 102, 104 to an electronic pitch changing apparatus 10.

Figure 2:
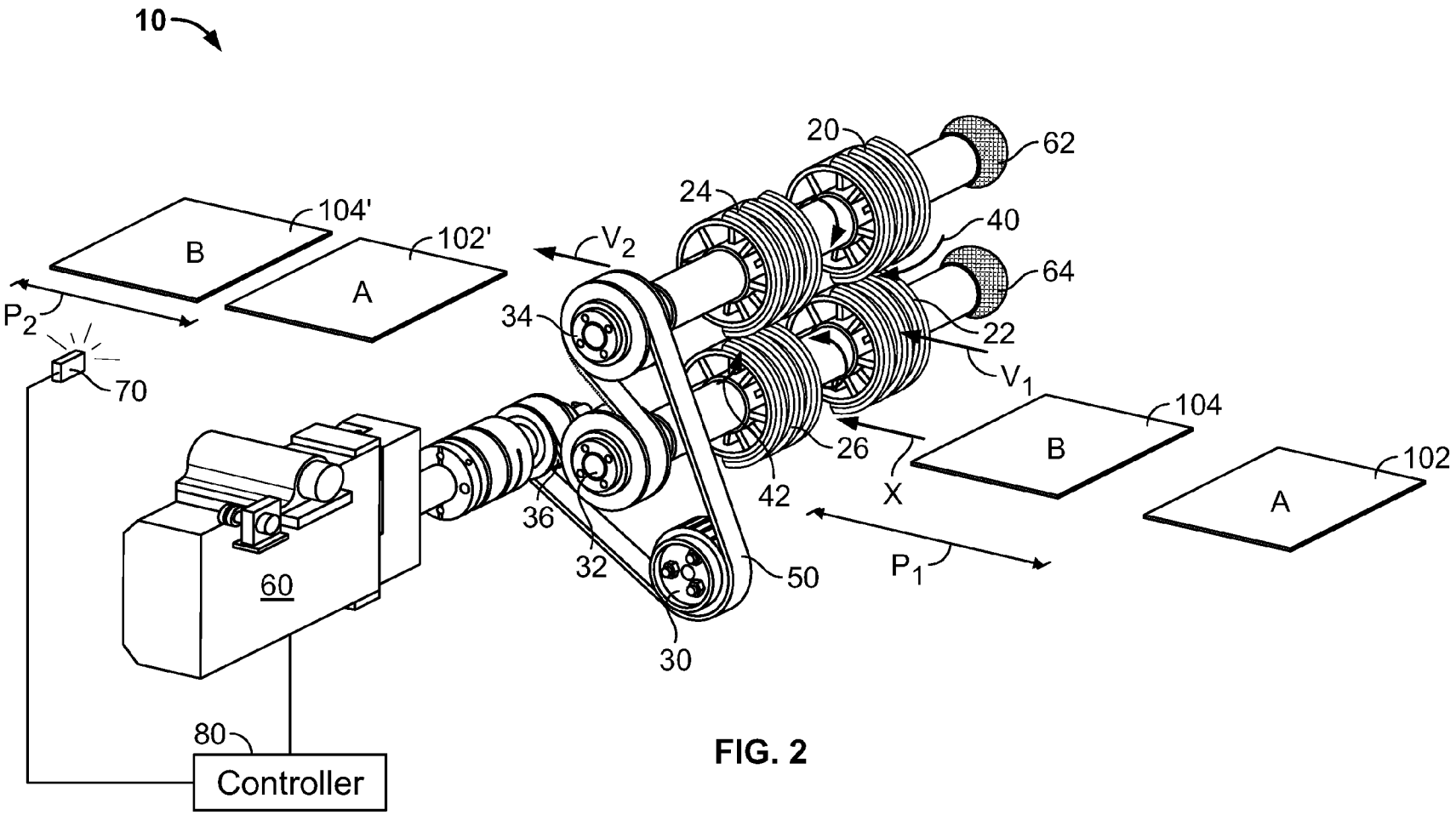
FIG. 2 shows an electronic pitch changing apparatus according to the present invention.

FIG. 2 shows an electronic pitch changing apparatus 10 in accordance with the present invention. Electronic pitch changing apparatus 10 includes rollers 20, 22, 24, 26. Rollers 20 and 22 create a nip 40 and rollers 24 and 26 create a nip 42. Rollers 20, 24 are mounted on axle 62 while rollers 22, 26 are mounted on axle 64. Axle 62 rotates in a clockwise direction while axle 64 rotates in a counter-clockwise direction. Axle 62 is connected to a roller 34. Axle 64 is connected to a roller 32.

A motor 60 drives a roller 36 and motor 60 is connected to a controller 80. Roller 36 drives rollers 30, 32 and 34 via belt 50. Roller 34 rotates in the clockwise direction, thus rotating axle 62 in the clockwise direction. Due to the arrangement of belt 50, roller 32 rotates in the counter-clockwise direction, thus rotating axle 64 in the counter-clockwise direction. Nips 40, 42 receive printed products 102, 104 and transport printed products 102, 104 in a direction X through nips 40, 42. Printed products 102', 104' correspond to printed products 102, 104 at a point in time after products 102, 104 have passed through electronic pitch changing apparatus 10.

The "pitch" or distance between the head of printed products may be varied by increasing or decreasing the velocity of printed products 102, 104, while printed products 102, 104, are transported through nips 40, 42. Distance (d) traveled by a printed product is equal to the product of the velocity (v) of the product and the time of travel (t), $d=v*t$. A direct relationship exists between the velocity of a printed product and the distance traveled by the printed product. Accordingly, decreasing the velocity decreases the distance traveled by the product.

Motor 60 has an electronic cam velocity profile designed to increase or decrease pitch of printed products 102, 104 by increasing or decreasing the velocity of the printed products 102, 104, respectively. The linear velocities of products 102, 104 and nips 40, 42 when products 102, 104 first come into contact with nips 40, 42 are the same, initial velocity $V_1$. The initial velocity $V_1$ is changed in accordance with the electronic cam velocity profile in motor 60. An initial pitch $P_1$ exists between products 102 and 104 before entering nips 40, 42. As shown in FIG. 1, the initial pitch $P_1$ between products 102' and 104' is decreased to a final pitch $P_2$ after products 102, 104 pass through nips 40, 42. A sensor 70 detects final pitch $P_2$ between products 104' and 102'. Sensor 70 is connected to controller 80. Controller 80 can control the velocity profile of motor 60 to adjust final pitch $P_2$ as desired. The electronic cam velocity profile may be similar to the electronic cam velocity profile in U.S. Publication No. 2007/0158903, hereby incorporated by reference herein, which discloses a variable speed motor having a sinusoidal speed variation cycle.

As shown in FIGS. 1 and 2, cam velocity profile 200 decreases pitch by decreasing the velocities of printed products 102, 104 in a product stream. For example, product 104 traveling at an initial velocity $V_1$ of 2750 FPM will travel 2750 feet in one minute. Product 102 traveling at an initial velocity $V_1$ of 2750 FPM will also travel 2750 feet in one minute. After decreasing the velocity of product 104 using the electronic pitch changing apparatus 10, the final velocity $V_2$ of corresponding product 104' upon exit of apparatus 10 is 1700 FPM, so product 104' will travel 1700 feet in one minute. Product 102 is still moving at an initial velocity $V_1$ of 2750 FPM. After product 104' is released from apparatus 10, the pitch between products decreases at a rate of about 1050 feet per minute, the difference between the final velocity $V_2$ of product 104' and initial velocity $V_1$ of product 102. The pitch decreases at this rate until product 102 enters apparatus 10, and is slowed down in the same manner as product 104.

Figure 3:
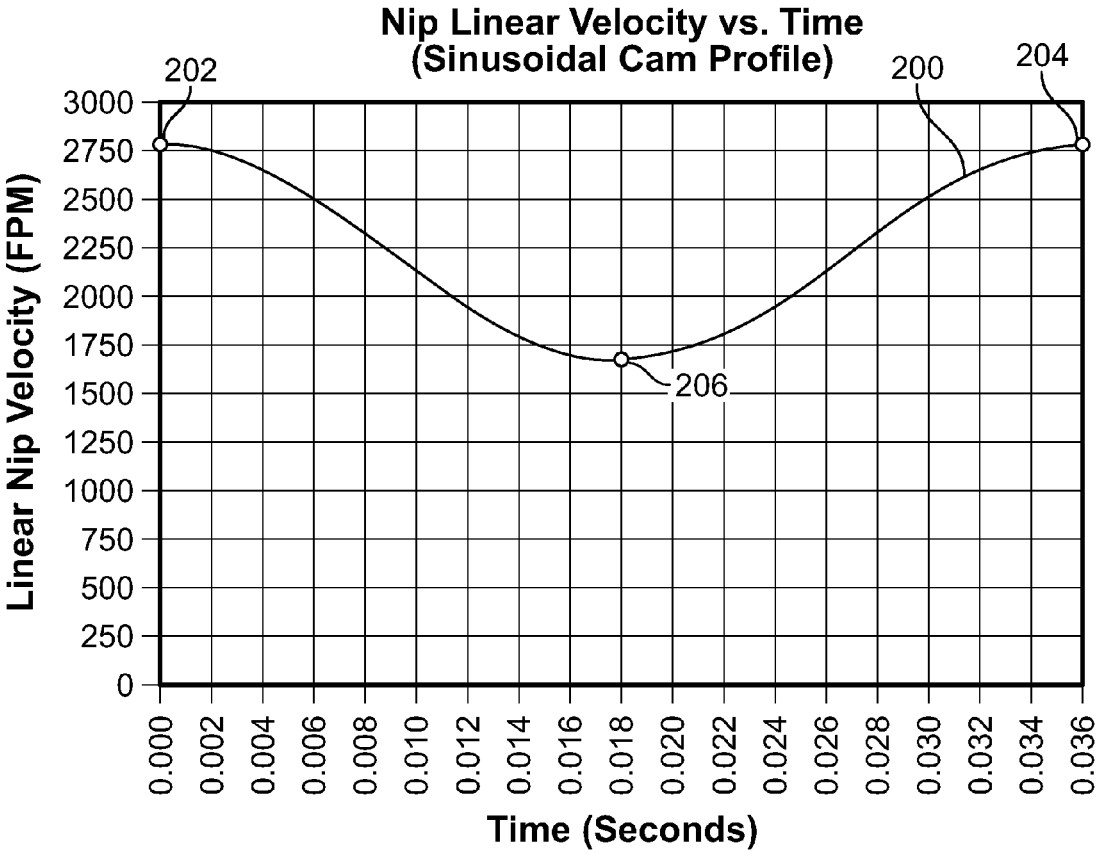
FIG. 3 shows a graph of nip linear velocity versus time for the electronic pitch changing apparatus shown in FIG. 2.

FIG. 3 shows the linear nip velocity over time charted as cam velocity profile 200. Profile 200 is a sinusoidal curve. As shown in FIGS. 2 and 3, the initial velocity $V_1$ is decreased to a final velocity $V_2$, reducing initial pitch $P_1$ to final pitch $P_2$, thereby decreasing the space between products 102', 104'. At entry into nips 40, 42 the linear initial velocity $V_1$ of both nips 40, 42 and product 104 is 2750 FPM. Entry of product 104 is indicated by point 202 on cam profile 200 in FIG. 3.

Motor 60, following cam velocity profile 200, reduces the initial velocity $V_1$, 2750 FPM of product 104 to final velocity $V_2$, 1700 FPM, upon exit of product 104' from apparatus 10. Motor 60 slows the initial velocity $V_1$ of nips 40, 42 and product 104 to 1700 FPM in 0.018 seconds, indicated by point 206 on cam velocity profile 200. At point 206, product 104' exits apparatus 10.

From 0.018 seconds to 0.036 seconds, no products may be transported through nips 40, 42. Following cam velocity profile 200, motor 60 brings the velocity of nips 40, 42 up to 2750 FPM in 0.018 seconds, as indicated by point 204. At this point, nips 40, 42 are ready to receive a subsequent product 102. Product 102 is slowed down in the same manner as product 104. The decrease in initial velocity $V_1$ to final velocity $V_2$ of products 102 and 104 results in a smaller final pitch $P_2$ between products 102' and 104' as compared to the initial pitch $P_1$ between products 102 and 104 as shown in FIG. 2.

Figure 4:
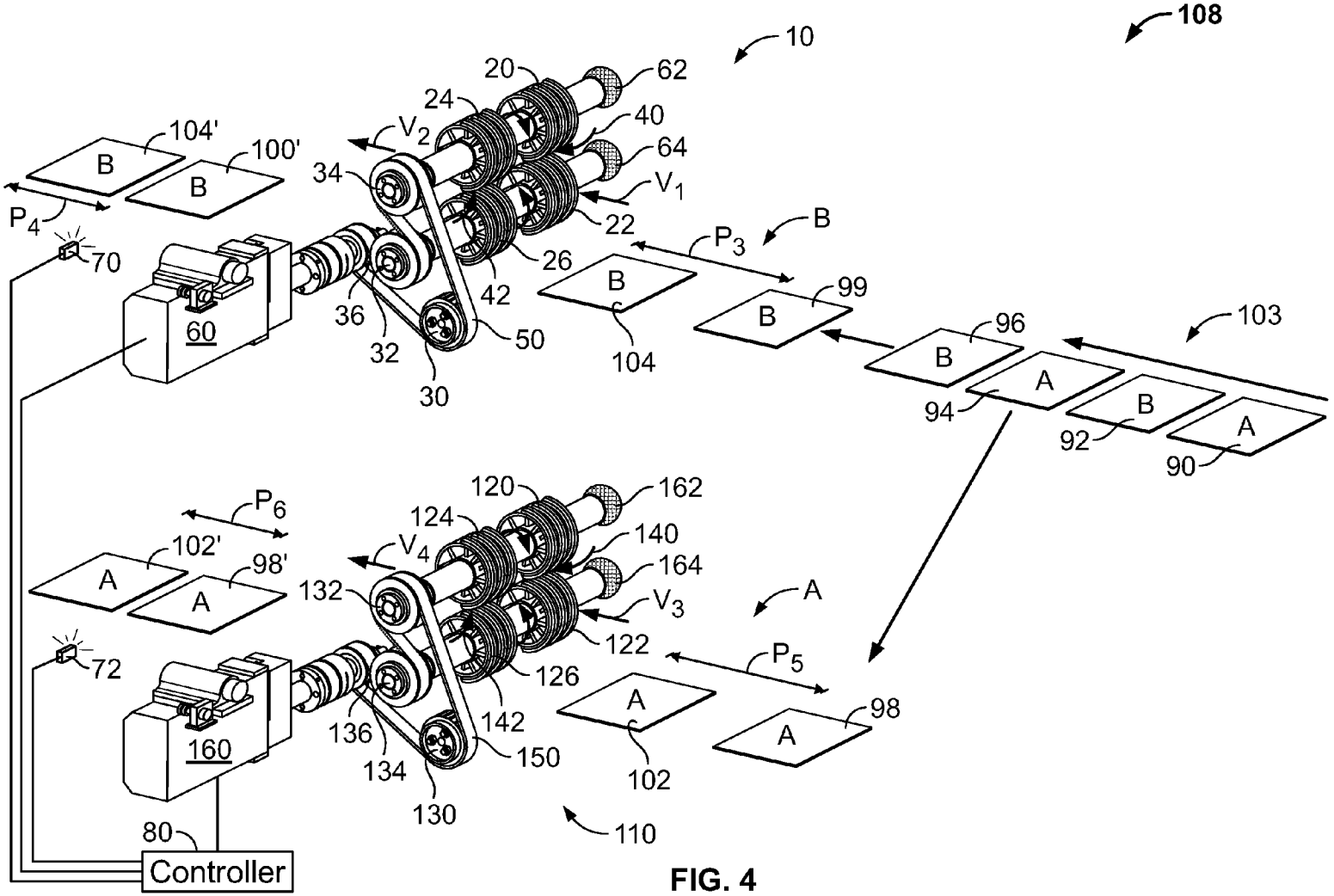
FIG. 4 shows two of the electronic pitch changing apparatus shown in FIG. 2.

FIG. 4 shows an arrangement 108 of two electronic pitch changing apparatus 10, 110. A single stream of products 103 is split into two product streams A, B by a diverter or stream separator as disclosed in, for example, U.S. Pat. No. 6,176,485. Electronic pitch changing apparatus 110 includes two axles 162, 164 connected to rollers 132, 134 respectively. Rollers 120 and 124 are mounted on an axle 162 and rollers 122 and 126 are mounted on an axle 164. Rollers 120 and 122 form a nip 140. Rollers 124 and 126 form a nip 142. A motor 160 drives axles 162, 164 via rollers 130, 132, 134, 136 and belt 150 and is connected to controller 80. Sensors 70, 72 are also connected to controller 80.

Figure 5:
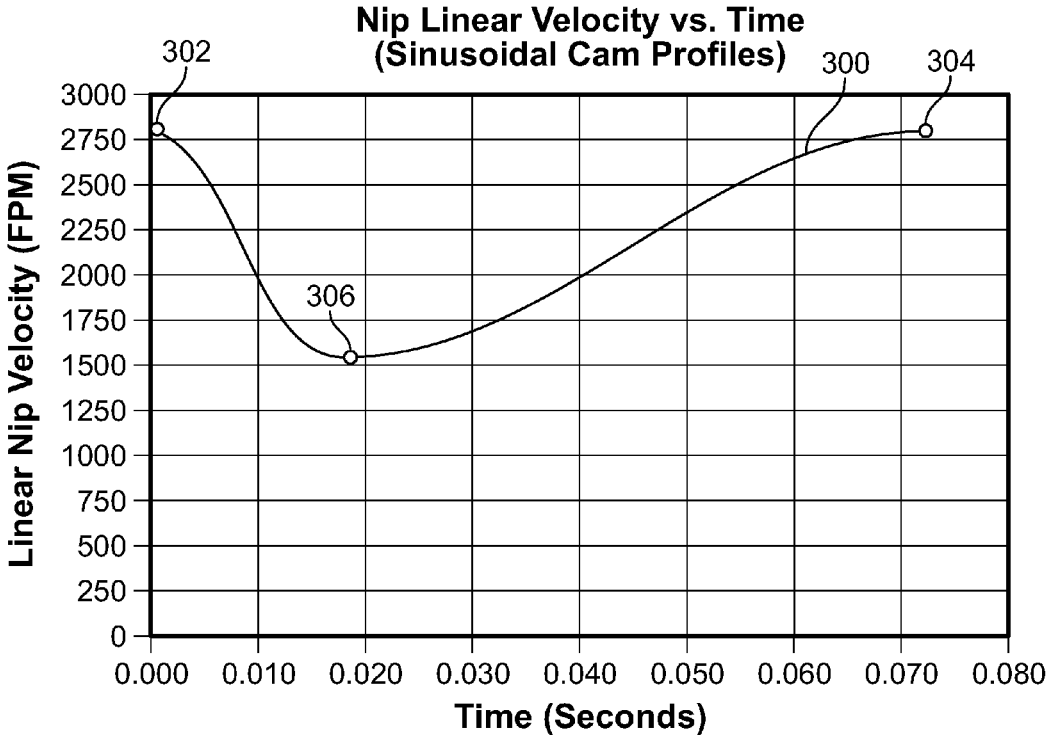
FIG. 5 shows a graph of nip linear velocity versus time for the electronic pitch changing apparatus shown in FIG. 4.

As shown in FIGS. 4 and 5, the length of time, nips 40, 42 and 140, 142 act on products 104, 99 and 102, 98, respectively, is the same as the length of time nips 40, 42 act on products 104, 102 as shown in FIGS. 2 and 3, 0.018 seconds. The length of time is dependent upon the velocity of the nips and the length of the printed products.

In arrangement 108, there is more time between products 104, 99 and 102, 98 entering nips 40, 42 and 140, 142, respectively, because a void is left between products when single product stream 103 is split into two product streams A, B. Thus, an initial pitch $P_3$ between products 104 and 99 and an initial pitch $P_5$ between products 102 and 98 is greater than the initial pitch $P_1$ between products 104 and 102 in FIG. 2.

The increased pitch and subsequent increase in time between products entering nips allows for changes in the cam velocity profile. FIG. 5 shows the linear nip velocity over time for apparatus 10, 110 charted as cam velocity profile 300. Profile 300 is a non-symmetrical sinusoidal curve. Profile 300 will be described as applied to apparatus 110; however, profile 300 may be applied in the same way to apparatus 10 of FIG. 4. At an initial time, 0.0 seconds, the linear velocity of both nips 140, 142 and product 102 is 2750 FPM. Entry of product 102 into nips 140, 142 is indicated by point 302 on cam profile 300.

Motor 160 following cam velocity profile 300 reduces the initial velocity $V_1$, 2750 FPM, of product 102 to final velocity $V_2$, 1500 FPM, upon exit of product 102' from apparatus 110. Motor 160 slows the initial velocity $V_3$ of nips 140, 142 and product 102 to 1500 FPM in 0.018 seconds, indicated by point 306 on cam velocity profile 300. At point 306, product 102' exits apparatus 110.

From 0.018 seconds to 0.072 seconds, no products may be transported through nips 140, 142. Following cam profile 300, motor 160 brings the velocity of nips 140, 142 up to 2750 FPM in 0.054 seconds, as indicated by point 304. At this point, nips 140, 142 are ready to receive a subsequent product 98. Product 98 is slowed down in the same manner as product 102. The decrease in initial velocity $V_3$ to final velocity $V_4$ of products 102 and 98 results in a smaller final pitch $P_6$ between products 102' and 98'. Sensor 72 detects final pitch $P_6$ between products 102' and 98'. Controller 80 may adjust the velocity profile of motor 160 to obtain a desired final pitch $P_6$.

Motor 160 has 0.054 seconds to bring the linear velocity of nips 140, 142 up to the initial velocity $V_3$ of 2750 FPM. This may be advantageous by reducing the amount of RMS torque required by motor 160. Thus, it may be easier for motors 60, 160 to work on separated streams A, B as shown in FIG. 4 than a single stream of products as shown in FIG. 2. Controller 80 can control the velocity profile of motor 160 to adjust final pitch $P_6$ as desired.

Figure 6:
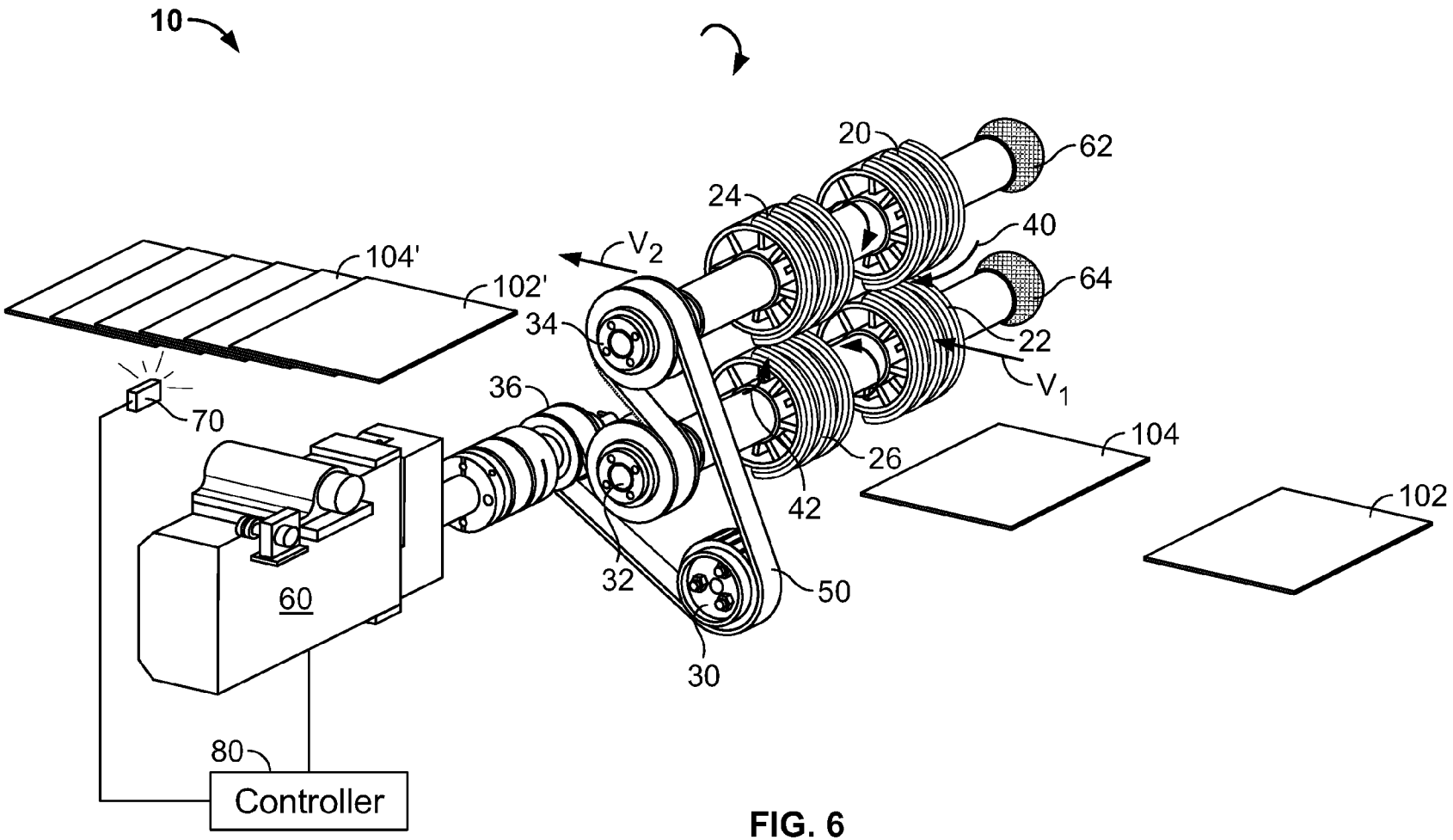
FIG. 6 shows the electronic pitch changing apparatus shown in FIG. 2 shingling printed products.

FIG. 6 shows electronic pitch changing apparatus 10 shingling products. The velocity $V_1$ of products 104 and 102 is decreased to a final velocity $V_2$ in order to overlap products 104', 102' upon exit from apparatus 10.

Figure 7:
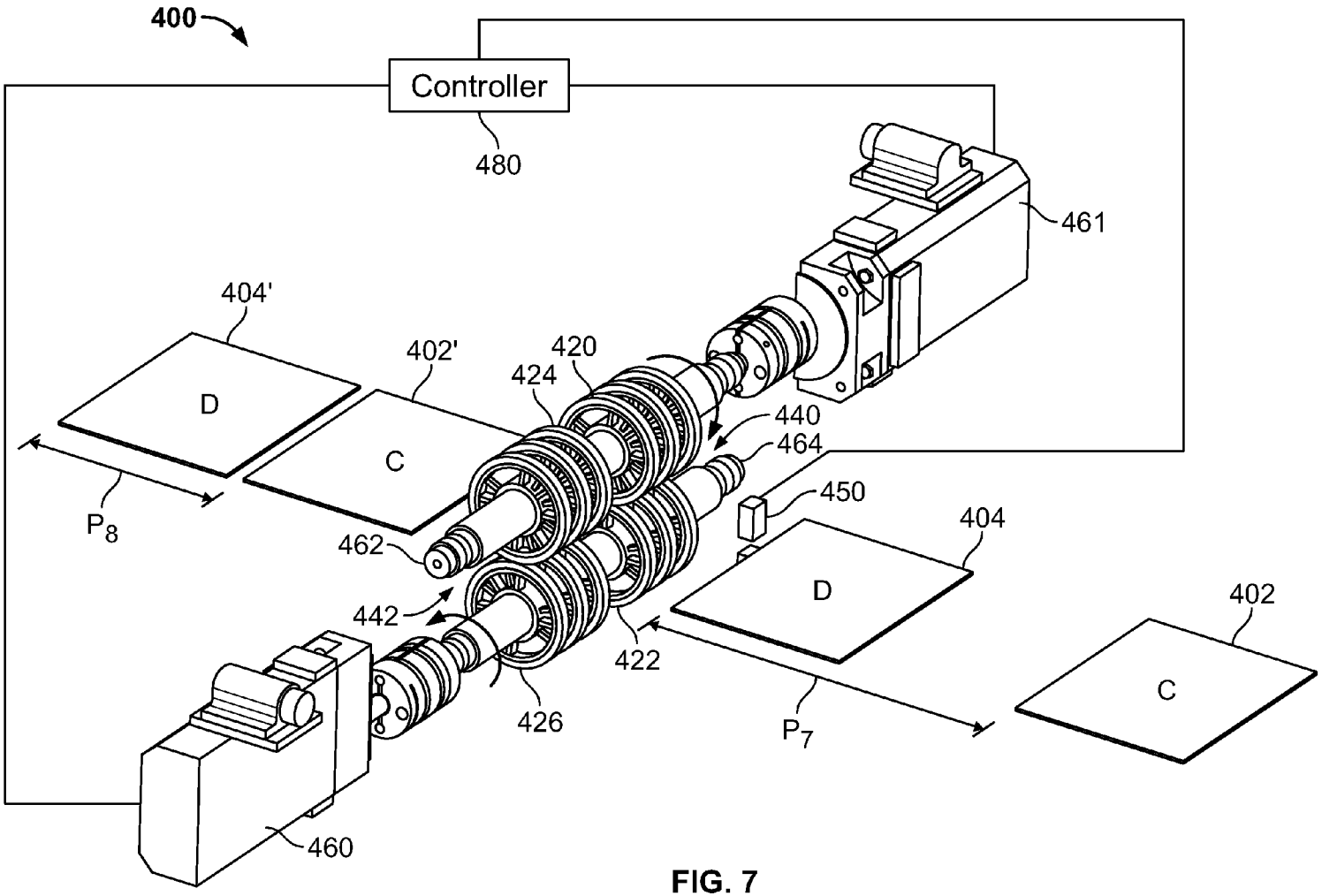
FIG. 7 shows another embodiment of the electronic pitch changing apparatus according to the present invention.
Figure 9:
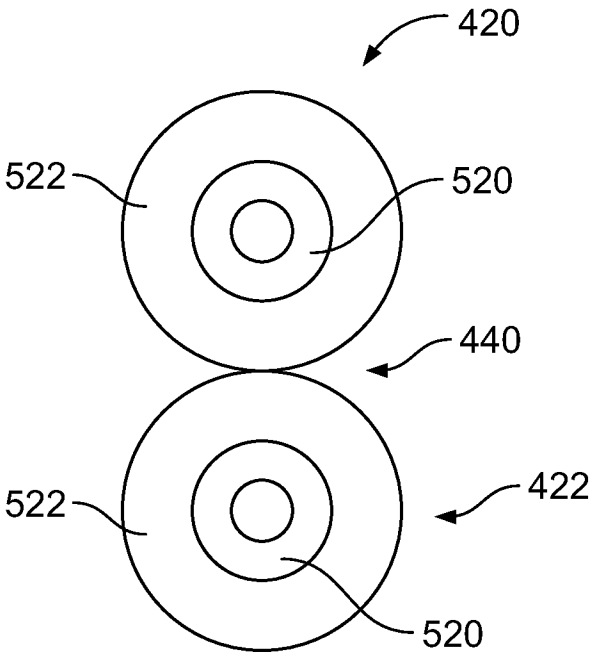
FIGS. 8 and 9 show schematically rollers of the electronic pitch changing apparatus in FIGS. 2 and 7, respectively.

FIG. 7 shows another preferred embodiment of an electronic pitch changing apparatus 400 in accordance with the present invention. Electronic pitch changing apparatus 400 includes rollers 420, 424 mounted on axle 462 and rollers 422, 426 mounted on axle 464. Roller 420 and roller 422 create a continuous nip 440 and roller 424 and roller 426 create a continuous nip 442. Rollers 420, 422, 424, 426 are surrounded in nip material 522 as shown in FIG. 9. FIG. 9 shows rollers 420 and 422 forming continuous nip 440. Both rollers 420, 422 include nip material 522 mounted around an entire circumference of roller base 520 (FIG. 9) forming a continuous nip 440 as rollers 420, 422 rotate on axles 462, 464 (FIG. 7). Edge sensors 450 are connected to controller 480 and detect a leading edge of products 404, 402 entering nips 440, 442.

Figure 8:
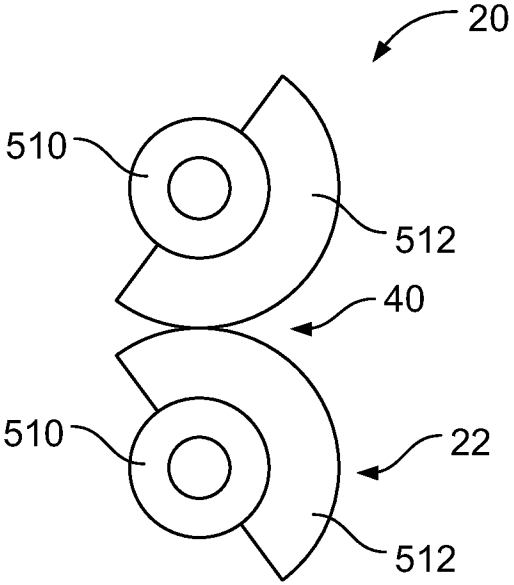

Alternatively, as shown in FIG. 8, rollers 20, 22 include nip material 512 mounted on only a portion of the circumference of roller base 510. Rollers 20, 22 create nip 40 when nip material 512 from roller 20 contacts or abuts nip material 512 from roller 22 as rollers 20, 22 rotate on axles 62, 64 shown in FIG. 2.

Referring back to FIG. 7, axle 462 rotates in a clockwise direction while axle 464 rotates in a counter-clockwise direction. A motor 460 drives axle 464 directly and a motor 461 drives axle 462 directly. Motors 460, 461 are connected to a controller 480.

Electronic pitch changing apparatus 400 works similarly to electronic pitch changing apparatus 10 in FIG. 2 to vary an initial pitch $P_7$ between products 404, 402. However, an edge sensor 450 will detect the leading edge of products 404, 402 entering nips 440, 442. Controller 480 keeps electronic cam profiles of motors 460, 461 accurately in phase with products 404, 402 to vary initial pitch $P_7$ to a final pitch Pg between products 404' and 402'. Controller 480 automates the initial timing and may reduce interaction and confusion for an operator.

The continuous nips advantageously may be used on all folder cutoff lengths since the length of the nips does not need to be resized. Continuous nips also advantageously provide flexibility since as little or as much of the nip surface may be used as desired.

The cam profile may be sinusoidal, symmetric or asymmetric. Cam profiles of individual motors do not have to be identical when a diverter or stream separator is used.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press comprising:
a print unit printing a stream of printed products, the printed products having a first pitch;
a pitch changing device including;
an upper roller mounted on an upper axle;
a lower roller mounted on a lower axle, the upper and lower rollers forming a roller nip; and
at least one motor driving the upper and lower rollers in opposite directions;
the roller nip receiving the stream of printed products; and
a controller, the controller connected to the at least one motor, the controller configured to decrease velocity from an initial velocity of the roller nip to a final velocity using an electronic cam velocity profile, wherein the printed products are released at the final velocity, and the controller configured to increase velocity from the final velocity of the nip to the initial velocity over a longer period of a cycle of the electronic cam velocity profile than said decreasing the initial velocity to the final velocity.

2. The device as recited in claim 1 further comprising a belt for rotating the upper and lower axles.

3. The device as recited in claim 1 further comprising a further upper roller on the upper axle and a further lower roller on the lower axle forming a further roller nip.

4. The device as recited in claim 1 further comprising a further motor for driving the upper and lower rollers, the at least one motor driving the upper roller and the further motor driving the lower roller.

5. The device as recited in claim 1 further comprising a second pitch changing device.

6. The device as recited in claim 1 wherein the printed product stream is split into a plurality of streams before entering the roller nip.

7. The device as recited in claim 1 wherein the electronic cam velocity profile is sinusoidal.

8. The device as recited in claim 1 wherein the electronic cam velocity profile is asymmetrical.

9. The device as recited in claim 1 wherein the pitch changing device shingles the printed products.

10. A method for changing the velocity of printed products in a product stream comprising the steps of:
moving printed products at a first velocity and a first pitch;
rotating a nip of two rollers at the first velocity;
receiving the printed products at the roller nip at the first velocity; and
decreasing the first velocity of the roller nip and printed products to a second velocity in a first time period using an electronic cam velocity profile so as to alter the first pitch;
releasing the printed products into a stream having a second pitch; and thereafter
increasing the second velocity of the roller nip to the first velocity,
wherein said increasing the second velocity to the first velocity is performed over a longer period of a cycle of the electronic cam velocity profile than said decreasing the first velocity to the second velocity.

11. The method as recited in claim 10 further comprising releasing the printed product at a second velocity during a first quarter of the cycle.

12. The method as recited in claim 10 further comprising the step of shingling the printed products.

13. The device as recited in claim 10 wherein the electronic cam velocity profile is sinusoidal.

14. The device as recited in claim 10 wherein the electronic cam velocity profile is asymmetrical.

* * * * *